United States Patent [19]

Hicks

[11] 4,051,586

[45] Oct. 4, 1977

[54] METHOD AND APPARATUS FOR MANUFACTURING A HELICALLY FINNED HEAT EXCHANGER

[75] Inventor: Robert E. Hicks, Crestwood, Ky.

[73] Assignee: General Electric Company, Louisville, Ky.

[21] Appl. No.: 737,833

[22] Filed: Nov. 1, 1976

Related U.S. Application Data

[63] Continuation-in-part of Ser. No. 529,445, Dec. 4, 1974, Pat. No. 3,909,898, which is a continuation-in-part of Ser. No. 579,889, May 22, 1975, abandoned.

[51] Int. Cl.[2] ..... B21D 53/02; B23P 15/26

[52] U.S. Cl. ..... 29/157.3 AH; 29/726; 29/727; 29/417; 113/1 C; 156/269

[58] Field of Search ..... 29/157.3 AH

[56] References Cited

U.S. PATENT DOCUMENTS

| | | | |
|---|---|---|---|
| 2,553,142 | 5/1951 | McCreary | 29/157.3 AH |
| 3,022,049 | 2/1962 | Abbott | 29/157.3 AH |

*Primary Examiner*—C.W. Lanham
*Assistant Examiner*—V. K. Rising
*Attorney, Agent, or Firm*—Frank P. Giacalone; Francis H. Boos

[57] ABSTRACT

A method and apparatus is disclosed for the manufacture of a continuous heat exchanger tube including helically winding a spine fin material on the outer wall of a base tube member. A preselected portion of the spine fin material is secured against movement relative to the base tube member. The heat exchanger is then severed in the secured portion so that a section of the secured portion is arranged at each end of the severed heat exchanger. The secured severed end sections are effective in maintaining the intermediate portion of the spine fin material from unwinding and, as a result, in heat transfer relationship with the base tube member.

1 Claim, 7 Drawing Figures

METHOD AND APPARATUS FOR MANUFACTURING A HELICALLY FINNED HEAT EXCHANGER

CROSS REFERENCE TO RELATED APPLICATIONS

The present application is a continuation-in-part of U.S. patent application Ser. No. 529,445 filed Dec. 4, 1974, now U.S. Pat. No. 3,909,898 for "The Method and Apparatus For Manufacturing A Helically Finned Heat Exchanger" which in turn is a continuation-in-part of U.S. patent application Ser. No. 579,889 filed May 22, 1975, now abandoned, for "The Method and Apparatus For Manufacturing A Helically Finned Heat Exchanger."

BACKGROUND OF THE INVENTION

1. Field of the Invention

This invention relates generally to the provision for manufacturing a continuous heat exchanger tube including helically winding a spine fin material formed to include a flange which is arranged in intimate contact with the outer wall of a base tube member and, more specifically, to the provision of securing a preselected portion of the spine fin material against movement relative to the base member. The heat exchanger is severed in the secured portion so that a section of the secured portion is arranged at each end of the cut length of each heat exchanger. The secured end sections arranged on each end of the heat exchanger are effective in maintaining the intermediate portions of the spine fin material in its original helically wound position.

2. Description of the Prior Art

In the manufacture of spine fin heat exchangers, it has been customary to use spine fin material of dissimilar metal than the base tube member, for example, the spine fin material has been fabricated of aluminum, while the base tube member has been copper. This use of dissimilar metals has resulted in galvanic corrosion of the relatively thin spine fin material. To overcome the problem of the galvanic corrosion and the resultant loss of spine fin material, an adhesive material has been applied between the flange of the spine fin material and the outer wall of the base tube member in amounts sufficient to prevent direct contact between the aluminum and cooper to prevent galvanic corrosion, while at the same time maintaining adequate heat transfer between them. While it was necessary to provide a complete film of adhesive between the contacting surfaces of dissimilar metals to prevent galvanic corrosion, it would not be required between similar metals since galvanic corrosion would not be a major factor. For example, if the base tube member was aluminum, it could be of the type that would have minimum reaction to the aluminum of the spine fin material. However, it should be noted that in the manufacture of continuous spine fin material by machines such as the one shown and described in U.S. Pat. No. 3,005,253—Venables assigned to the General Electric Company, assignee of the present invention, wherein the fabricated spine fin heat exchanger is cut into predetermined lengths during the manufacturing and winding operations, the lack of means for securing the spine fin material against movement relative to the base tube member would cause the spine fin material to start unwinding from its loose ends and thereby lose its heat transfer advantages.

It is therefore an object of the present invention to provide the spine fin heat exchanger where selected portions of the spine fin material are secured against movement relative to the base tube member in a manner effective to prevent the other portion of the spine fin material from moving relative to the base tube member.

SUMMARY OF THE INVENTION

According to the present invention, there is provided a method and apparatus for manufacturing from a continuous heat exchanger a predetermined length of spine fin heat exchanger having a spine fin material helically wound on a base tube member and being secured at each end of the predetermined length. The spine fin material is wound on the base tube member as it is being advanced at a preselected speed so that the spine fin material is in intimate contact with adjacent wraps and the outer wall of the tube member. A preselected portion of the spine fin material at spaced intervals on the spine fin heat exchanger are secured against movement relative to the base tube member. Finally, the spine fin heat exchanger is severed in the secured portion to form the predetermined lengths of the heat exchanger with the secured cut portions forming end portions that are held against movement relative to said base tube member and that are effective to maintain the intermediate portion of the spine fin material in its initial helically wound position.

DETAILED DESCRIPTION OF THE INVENTION

Figure 1:
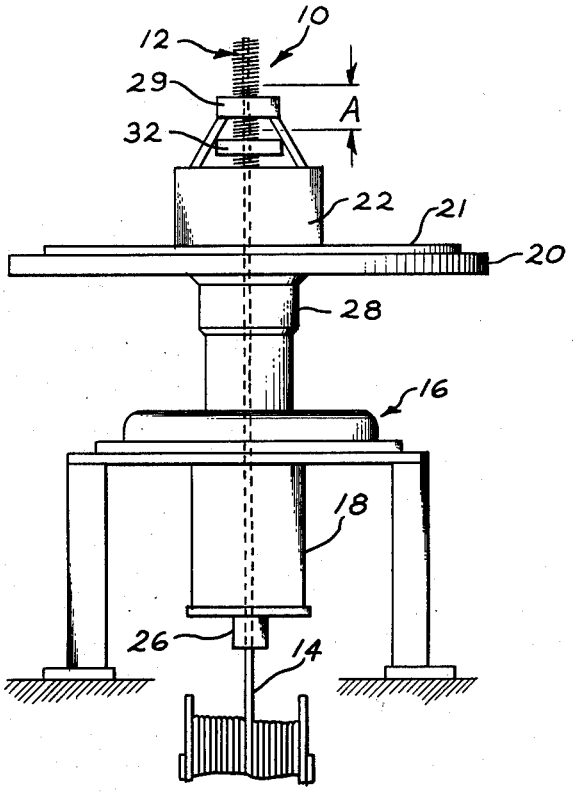
FIG. 1 is a schematic view of an apparatus for fabricating a heat exchanger in accordance with one embodiment of the invention.

In the embodiment of FIG. 1, a continuous spine fin heat exchanger 10 of the type having a continuous spine fin material 12 is helically wound on a base tube member 14. The details of construction of an automatic machine 16 that may be employed in fabricating the present invention is shown and described in U.S. Pat. No. 3,005,253—Venables, assigned to the General Electric Company, the assignee of the present invention. A suitable base tube member 14 is fed vertically upward by feeding means 18 through the machine 16. A rotating support table 20 is arranged for rotation about a vertical axis. The table 20 carries a coil of sheet stock 21 which is fabricated into the spine fin material 12 as well as the fin wrapping and forming assembly 22.

In operation the tube base member 12 is fed through an axial passage in the rotating support table 20 and past the fin wrapping and forming assembly 22. The forming assembly includes means for bending the strip stock to form a base flange 24 and for lancing the strip to form fin sections 25. The wrapping assembly includes means for helically winding the spine fin material 12 onto the base tube member 14 as it advances through the machine 16 under tension so that the base flange 24 is in intimate heat transfer contact with outer tube wall. During the continuous wrapping operation, the fabricated spine fin heat exchanger 10 is cut into predetermined lengths 11 to be formed into condensers or evaporators to be used in refrigeration systems. The means for severing the heat exchanger may include a cutting or severing station 29 that may be activated after the heat exchanger 10 reaches a predetermined length. In fabricating heat exchangers wherein the base tube member and spine fin material were of dissimilar materials as in the case of employing a copper tube and aluminum spine fin material resulted in galvanic corrosion. To alleviate this problem, adhesive was used between the aluminum spine fin material and the copper tube to prevent their contact while maintaining adequate heat transfer between the two. The use of a base tube and spine fin of similar material wherein aluminum tubing is employed for use with aluminum spine fin material does not require that adhesive or other material be used between them to prevent galvanic corrosion as in the case of dissimilar metals. It should be noted, however, that the unsecured spine fin material 12 at the ends of the severed heat exchanger 10 would unwrap from the base tube member 14 if the spine fin material was not secured against movement relative to the base tube member.

Figure 2:
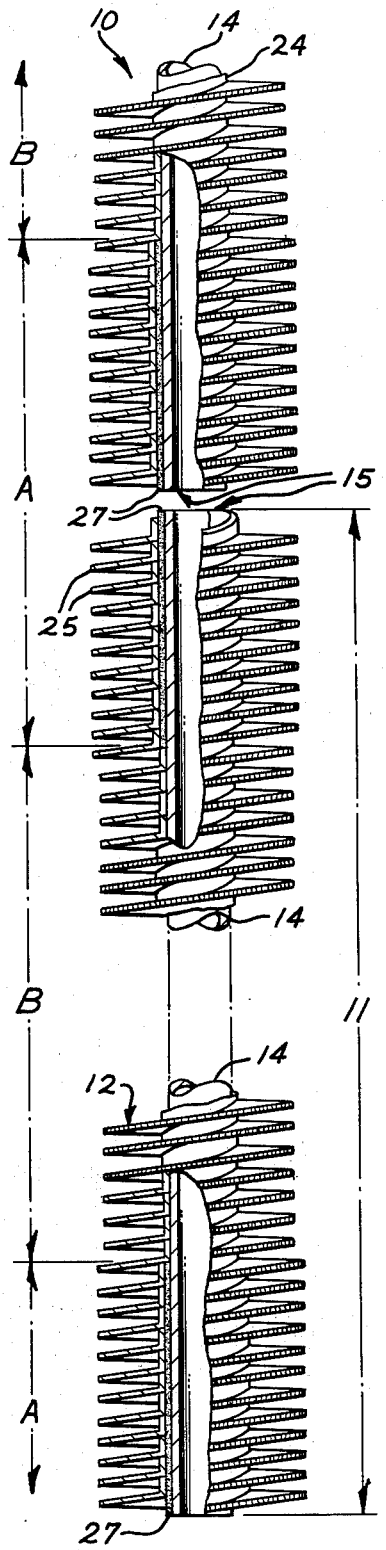
FIG. 2 is a schematic view of the heat exchanger formed according to the preferred embodiment of the present invention.

Accordingly, a method and apparatus are provided by the present invention to secure preselected portions of spine fin material 12 against movement relative to the base tube member 14. Referring to FIGS. 1 and 2, the preselected portions of the heat exchanger 10 of the spine fin material 12 that is secured against movement relative to the base tube member 14 is designated A. Control or sensing means 26 may be provided at a convenient location to accurately control the length of portion "A" and the distance between them and to activate the cutting station 29 so that the heat exchanger 10 is severed substantially at the midpoint of portion A. While it is critical to the present invention that the heat exchenger 10 is cut within the portion "A", the exact location or construction of the control or sensing means 26 for activating the cutting station 29 may be optional. For purposes of simplicity, the control or sensing means 26 has been shown schematically at the inlet or tube receiving end of the machine 16. Referring to FIG. 2, it will be apparent that the severed sections of portion A form the end portion of each cut section 11 of heat exchanger 10 wherein the spine fin material 12 is secured against movement relative to the base tube member 14. The secured portions A at each end of the cut heat exchanger are effective in maintaining the tension wrapped intermediate portion of spine fin material designated B in FIG. 2 in its initial helically wound heat transfer position.

The means for securing the portion A against movement relative to the tube 14 may be a coating of adhesive 27 applied to preselected sections of the tube as it advances through the machine. Referring to the embodiment shown in FIG. 1, the adhesive may be applied by a dispensing means 28 arranged between the feeding means 18 and the forming assembly 22. The dispensing means 28 may be activated by the control means 26 which, in turn, may monitor the advancing tube 14. The dispensing means 28 under control of means 26 effectively applies adhesive 27 to the base tube 14 at preselected intervals and for a predetermined length to provide portion A so that the spine fin material 12 engaging the adhesive is secured against movement relative to the base tube 14. In effect, only the spine fin material 12 arranged in the portion A of the heat exchanger 10 is secured to the base tube member 14 which, as hereinbefore noted, is effective in maintaining the portion B in its original helically wound position.

The cutting station 29, while shown arranged in close proximity to the machine 16, may be located in other convenient locations, and like the dispensing means 28, the cutting station 29 may be activated by the control means 26. While it is not critical in what manner the station 29 is activated, it is, however, necessary as previously explained that the heat exchanger 10 be severed in the secured portion A to form the lengths 11.

Figure 3:
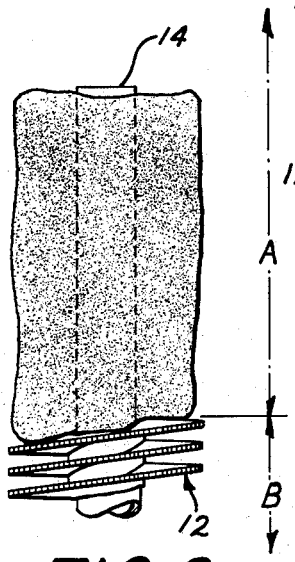
FIG. 3 shows a heat exchanger fabricated in accordance with another embodiment of the invention.

In another embodiment of the invention as shown in FIG. 3, the means for securing the spine fin material 12 relative to the base tube member 14 in portion A employs the use of an adhesive or bonding material that is applied over the spine fin material 12 after the forming and wrapping operations. In accordance with this embodiment, a sufficient amount of adhesive is applied so that the spine fins of adjacent wraps are encapsulated or joined together as one unit so that the unwinding of severed or cut end of portion A is prevented.

Figure 4:
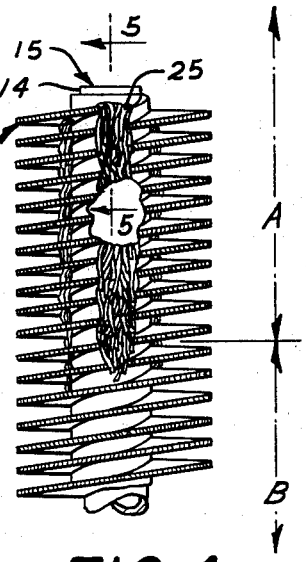
FIG. 4 shows a heat exchanger fabricated in accordance with still another embodiment of the invention.
Figure 6:
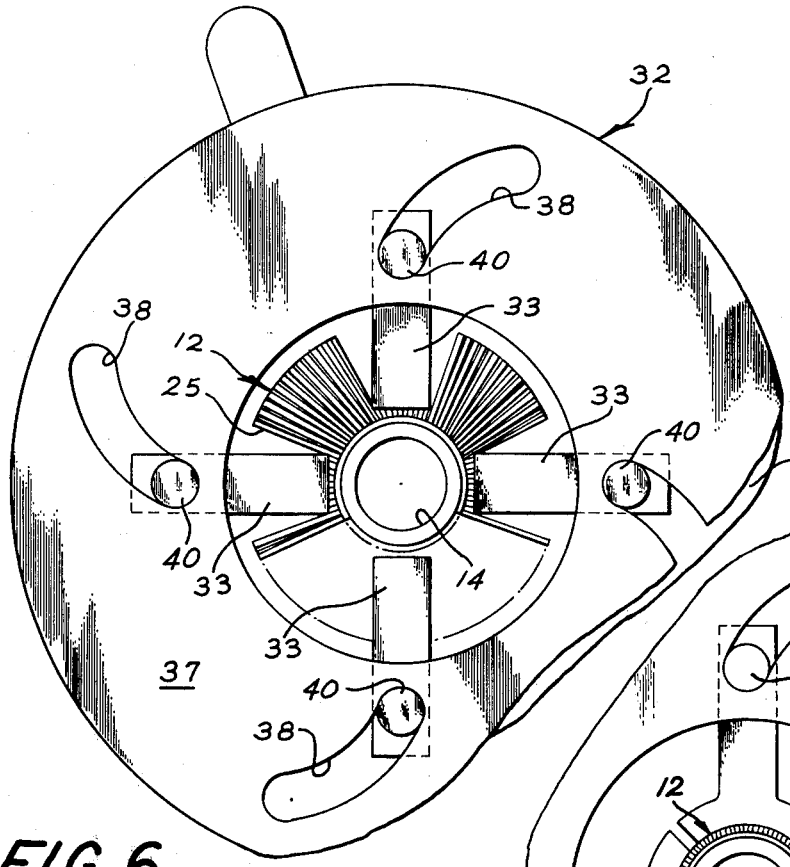
FIG. 6 shows a means for carrying out the embodiment shown in FIGS. 4 and 5.
Figure 5:
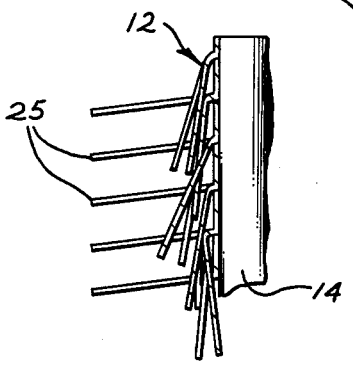
FIG. 5 is an enlarged sectional view taken along lines 5—5 of FIG. 4.

In still another embodiment of the invention as shown in FIGS. 4, 5 and 6, the spine fin material 12 is secured against movement relative to the tube member 14 by mechanically moving the spine fins 25 of one pass of the helically wrapped spine fin material 12 in portion A into interlocking engagement with an adjacent pass so as to form a unitary section of interlocked spine fin material 12 that effectively resists movement relative to the base tube member 14. This interlocking of spine fins 25 in portion A forms a unitary section of spine fin material 12 adjacent the severed end 15 when the heat exchanger is cut in portion A in the cutting station 29. It has been found that this interlocking of spine fins 25 of adjacent wraps in portion A and more particularly adjacent the severed ends of the heat exchanger 10 forms an effective holding means that prevents the unwrapping of the spine fin material 12 from the base tube member 14.

To carry out this embodiment of the invention means are provided to effectively deform or move the fins 25 into interlocking engagement with fins of adjacent wraps. Accordingly securing means including a deforming or fin moving means 32 is arranged between the forming assembly 22 and the cutting section 29.

While the moving of spine fins 25 of one pass of the helically wound spine fin material 12 into engagement with spine fins of an adjacent pass is necessary to provide an effective means of securing the spine fin material 25 against movement relative to the base tube member 14 it should be understood that this interlocking may be accomplished by any number of mechanisms. Accordingly the exact configuration of the deforming means 32 does not form a part of this invention and the configuration shown herein in accordance with this embodiment is intended to show one convenient way of moving the spine fins 25 of adjacent wraps into interlocking engagement with each other in a manner that will effectively hold the spine fin material 12 in portion A adjacent the severed end portion of heat exchanger 10 against movement relative to the base tube member 14.

The deforming means 32 may include a plurality of members or rollers 33 that are activated by the control means 26 to engage the heat exchanger 10 and more particularly the spine fins 25 in section A as it advances past the deforming means 32.

It has been determined that when the spine fins 25 are deformed along circumferentially spaced axially disposed rows that the spine fin material 12 is effectively held against movement relative to the tube member 14. Accordingly a plurality of circumferentially spaced members 33 are provided in the deforming means 32. With reference to FIG. 6 there are shown four members 33, spaced equidistance, however, it should be noted that one or more rows would work effectively.

At the appropriate time during the fabrication of the heat exchanger, portion "A" of heat exchanger 10 advances through the deforming means 32 wherein an actuating means (not shown) moves the members 33 of the deforming means 32 into engagement with the spine fins 25 as the preselected portion "A" passes through the deforming means 32. The members 33 may be arranged to move radially inwardly on a stationary plate member 35. The members 33 in the embodiment shown include actuation projections 40 that extend into camming slots 38 arranged in a rotatably mounted member 37. As can easily be understood when portion "A" in which the heat exchanger 10 is to be severed is passing through the deforming means the actuating means (not shown) is activated to impart a rotational movement to plate member 37 causing members 33 to move radially inwardly through action of cam slot 38 on projections 40 so that the spine fin material 12 is deformed along an axial strip caused by members 33 which are in the path of the radially extending spine fins 25.

The members 33 are maintained in the actuated position in the path of spine fins 28 as shown in FIG. 6 during the time portion A passes through the deforming means 32. FIGS. 4, 5 and 6 show deformation and interlocking of spine fins 25 of the spine fin material 12 along longitudinal or axially arranged strips o r sections of the heat exchanger 10, wherein individual radially projecting fins 25 become entangled with individual fins of adjacent wraps of spine fin material 12.

Figure 7:
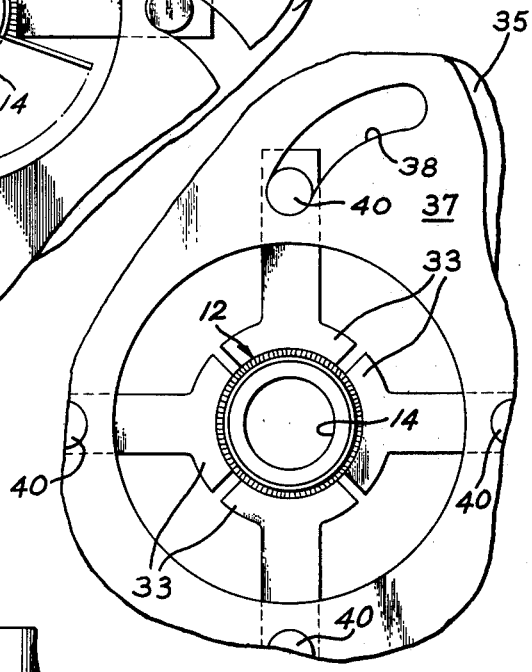
FIG. 7 shows another means for carrying out the embodiment shown in FIGS. 4 and 5.

As mentioned hereinbefore any number of members 33 may be used and in fact the members 33 may be so dimensioned as shown in FIG. 7 that in their actuated or extended position the radially extending spine fins 25 of the spine fin material 12 will be deformed and interlocked around the entire circumference of the heat exchanger 10 rather than along selected strips as shown in FIGS. 4, 5 and 6.

The foregoing is a description of the preferred embodiment of the invention. In accordance with the Patent Statutes, changes may be made in the disclosed apparatus and the method in which it is assembled without actually departing from the true spirit and scope of this invention as defined in the appended claims.

What is claimed is:

1. Method of manufacturing a continuous spine fin heat exchanger tube including a helically wound spine fin material supported on a base tube member which comprises:

helically winding said spine fin material in intimate contact with adjacent wraps and the outer wall of said tube;

moving spine fins from adjacent wraps of said spine fin material into interlocking engagement in preselected portions at spaced intervals on said spine fin heat exchanger so as to prevent movement thereof relative to said base tube member;

severing said heat exchanger in said preselected portion to form predetermined lengths of said heat exchanger with the interlocked spine fin material in said preselected portions forming end portions effectively held against movement relative to said base tube member so that the other portion of said helically wound spine fin material intermediate said preselected portion is maintained in its initial helically wound position.

* * * * *